US006106450A

United States Patent [19]

Brittain

[11] Patent Number: 6,106,450

[45] Date of Patent: Aug. 22, 2000

[54] APPARATUS AND METHOD FOR SET-UP OF A NON-RECTANGULAR CONTAINER FROM A KNOCKED-DOWN-FLAT (KDF) PRECURSOR

[75] Inventor: Jody A. Brittain, North Augusta, S.C.

[73] Assignee: Georgia-Pacific Corporation, Atlanta, Ga.

[21] Appl. No.: 09/087,958

[22] Filed: Jun. 1, 1998

[51] Int. Cl.[7] ..... B31B 1/46

[52] U.S. Cl. ..... 493/171

[58] Field of Search ..... 493/167, 171, 493/176, 175, 183, 316, 313

[56] References Cited

U.S. PATENT DOCUMENTS

| | | | |
|---|---|---|---|
| 1,192,202 | 7/1916 | Johnson et al. | 493/176 |
| 1,422,580 | 7/1922 | Kondolf . | |
| 1,894,209 | 1/1933 | Wikstrom . | |
| 2,967,655 | 1/1961 | Seger, Jr. . | |
| 3,590,700 | 7/1971 | Paxton | 93/55 |
| 4,008,651 | 2/1977 | Pain | 93/81 R |
| 4,010,597 | 3/1977 | Nelson | 53/374 |
| 4,308,023 | 12/1981 | Bidegain . | |
| 4,349,345 | 9/1982 | Bodendoerfer . | |
| 4,601,687 | 7/1986 | Gallaher | 493/89 |
| 4,759,167 | 7/1988 | Langen et al. | 53/142 |
| 4,843,798 | 7/1989 | Focke et al. . | |
| 4,932,930 | 6/1990 | Coalier et al. . | |
| 5,147,269 | 9/1992 | Jondelius | 493/57 |
| 5,147,271 | 9/1992 | Bacques et al. . | |
| 5,193,328 | 3/1993 | Boriani et al. | 53/466 |
| 5,269,741 | 12/1993 | Fischer | 493/143 |
| 5,375,715 | 12/1994 | Serre et al. . | |
| 5,381,948 | 1/1995 | Coalier et al. . | |
| 5,400,955 | 3/1995 | Coalier et al. . | |
| 5,505,369 | 4/1996 | Taliaferro | 229/117.16 |
| 5,527,254 | 6/1996 | Taliaferro | 493/180 |
| 5,624,368 | 4/1997 | Cromwell | 493/312 |
| 5,656,006 | 8/1997 | East et al. . | |
| 5,807,225 | 9/1998 | Nowacki et al. | 493/167 |

OTHER PUBLICATIONS

Davis, Glenn C. *Packaging Machinery Operations,* Chapter 5 Case Packing, Packaging Machinery Manufacturers Institute, Aug. 1980.

Brochure: Edson Model 3100 Automatic Case Opener–Packer–Sealer, date unknown but believed to precede 1986.

Brochure: Bemis Packaging Service Machinery Co. Case Erectors, including Series 1547 Automatic Case Packer Technical Bulletin, date unknown.

Brochure: Wexxar Case Sealer Model TB–8 Hot Melt, date unknown.

Brochure: Stone Container Corporation Case Erector, Automatic Model CE–550, date unknown.

*Primary Examiner*—Joseph J. Hail, III
*Assistant Examiner*—Dermott J. Cooke
*Attorney, Agent, or Firm*—Banner & Witcoff, Ltd.

[57] ABSTRACT

A modification of conventional case packing equipment for forming rectangular containers from knocked-down-flat (KDF) precursors allows formation of non-rectangular containers having one or more oblique wall panels, e.g., an octagonal container. As part of a conveyor line operation, a ram head assembly is advanceable into a rectangular tube erected from a KDF container precusor. The ram head assembly includes a pair of plows which are movable outwardly from a base of the ram head assembly and into engagement with opposing interior sides of the rectangular tube such that oblique corner wall panels are positively formed along score lines provided in the precursor. In addition to forming the oblique wall panels, the plows provide pressing surfaces for facilitating adhesive securement of the container closure flaps while the plow maintains the oblique wall panels in a proper orientation. Once the closure flaps are secured, the container shape is stabilized, the plows are retracted out of engagement with the container walls, and the ram head assembly is retracted from the resultant container.

28 Claims, 2 Drawing Sheets

APPARATUS AND METHOD FOR SET-UP OF A NON-RECTANGULAR CONTAINER FROM A KNOCKED-DOWN-FLAT (KDF) PRECURSOR

BACKGROUND OF THE INVENTION

The present invention relates to the automated formation of containers from sheet material preformed (e.g., scored, slotted, folded and glued) as a knocked-down-flat (KDF) container precursor. In particular, the invention concerns an apparatus and associated method that allow for an extension of conventional KDF set-up methodology and equipment to the formation of non-rectangular containers, i.e., containers having one or more oblique wall panels.

Conventional KDF precursors have four wall panels and associated end flaps which form a finished box of rectangular shape. Such KDF precursors are typically purchased in bulk by product manufacturers and erected at the manufacturer's facility using a case erector and sealing machine (case packer). A conventional case packer takes the KDF precursors, one at a time, from a stack and places them on a conveyor. The conveyor delivers the KDF precursor to a station where a gripper arm or the like is used to open the precursor so that it assumes a rectangular tubular shape corresponding to the box to be formed. During conveyance of the rectangular tube to a second station, tuckers tuck in, at right angles, a first pair of bottom flaps. At a subsequent station, adhesive is applied to the tucked flaps, and pivotal arms fold a second pair of bottom flaps over and into adhering contact with the fist pair of flaps. The resultant case is thereafter conveyed to a final station where it is presented for filing with the manufacturer's product. An exemplary case packing machine of the foregoing type is the Bemis Series 1547 Case Packer, available from Bemis Packaging Service Machinery Co. of East Minneapolis, Minn.

The above-described KDF methodology is highly efficient, but is only suitable for use in forming containers of rectangular shape. For certain packing applications, a rectangular container may not ideally accommodate (with optimum space efficiency) the item(s) to be packed, e.g., items such as bottles or paper towels having a circular footprint. Also, in situations where the contents of the containers is relatively heavy, a rectangular box may provide insufficient wall strength for stacking. If the product to be packed is a flowable solid such as plastic pellets, the wall panels may lack sufficient stiffness to prevent bulging (elephant footing) of the wall panels.

Non-rectangular containers having oblique wall panels, e.g., octagonal containers, have been developed which are better suited for certain packing applications as described above. However, the known methods for forming such containers lack the simplicity and efficiency of the above-described conveyor line system used to automatically form rectangular containers from KDF precursors. Moreover, for manufacturers desiring to package product in both rectangular and octagonal (or other non-rectangular) containers, it has been necessary to provide separate machines for the set-up and packing of each container type.

Cromwell U.S. Pat. No. 5,624,368 discloses a method and apparatus for erecting an octagonal box structure from a KDF precursor, wherein the precursor is first lowered over a center post. The octagonal container shape takes form as a movably mounted three-sided box folding frame, generally conforming to the angular configuration of three wall panels of the box, advances toward a fixed five-sided box folding frame generally conforming to the desired final configuration of the remaining five wall panels. Wing plates mounted on the post aid in the proper opening of the box. Once the box has been expanded into an octagonal form, a main frame suspended above the box is lowered to provide a progressive folding of end closure flaps.

Bacques et al. U.S. Pat. No. 5,147,271 teaches a method of forming a polygonal, e.g., octagonal, case from an unfolded blank (not a KDF). The method includes wrapping the blank around a mandrel and gluing opposite end panel edges together to form a tubular shape. Thereafter end flaps of the case are folded over and glued.

East et al. U.S. Pat. No. 5,656,006 and Wikstrom U.S. Pat. No. 1,894,209 each disclose formation of a box by advancing, with a mandrel or plunger, an unfolded blank through a forming or folding assembly serving to wrap wall forming panels of the blank about the mandrel or plunger as the blank moves through the folding assembly.

Kondolf U.S. Pat. No. 1,422,580 discloses a box pressing machine comprising a male die which advances into a female die and then expands outwardly to apply final pressure to the sides, ends and corners of a rectangular box carried by the male die into the female die.

SUMMARY OF THE INVENTION

In view of the foregoing, it is a principal object of the present invention to provide a machine and method that can be used to quickly and continuously form, from KDF precursors, non-rectangular containers with one or more oblique wall panels, e.g., octagonal packing cases.

It is a further object of the invention to provide for ready retrofitting of existing KDF case packing equipment, so as to allow such automated formation of non-rectangular containers.

It is yet another object of the invention to provide an apparatus with quick-change parts allowing a single case packing machine to be used to form a range of rectangular and non-rectangular container configurations, without time-consuming and expensive modifications of the machine.

These and other objects are achieved in accordance with the present invention by a method of setting-up a non-rectangular container with an oblique wall panel from a knock-down-flat (KDF) precursor formed of scored, slotted and folded panels of sheet material. In the method, a KDF precursor is opened to form a rectangular tube. A ram head assembly including a base and a plow movable toward and away from the base is advanced into the rectangular tube. The plow is actuated to move away from the base and into engagement with an interior side of the rectangular tube, to thereby form an oblique wall panel of the container angled obliquely with respect to two adjoining container wall panels. End flaps of the container are folded over into contact with each other, and the end flaps are secured to each other while the plow is engaged with the interior side. The plow is actuated to retract from the interior side following the securing. Finally, the ram head assembly is retracted out of the resultant container.

In a second aspect, the invention is embodied in an apparatus for forming a non-rectangular container as aforesaid. A support device is provided for supporting a rectangular tube erected from a KDF precursor. A ram head assembly is movably mounted adjacent the support device and includes a base and a plow. A first actuator is provided for controllably moving the ram head assembly into and out of a rectangular tube positioned on the support device. A second actuator is provided for controllably moving the plow away from the base and into engagement with an interior side of the rectangular tube, to hereby form an oblique wall panel of the container angled obliquely with respect to two adjoining container wall panels. Folding means fold over end flaps of the rectangular tube into contact with each other, and securing means secure the end flaps to each other while the plow is engaged with the interior side. The second actuator causes the plow to retract from engagement with the interior side following operation of the securing means. The first actuator retracts the ram head assembly out of the resultant container after retraction of the plow.

In a third aspect, the invention provides a ram head assembly for use in an apparatus as aforesaid. Therein, a base is adapted for attachment to movement actuating means. A plow is movably mounted on the base. The plow has forming surfaces which, when pressed against an interior side of a rectangular tube erected from the KDF precursor, form an oblique wall panel of the container angled obliquely with respect to two adjoining contain wall panels. An actuator controllably moves the plow away from the base and into engagement with the interior side of the rectangular tube.

In a fourth aspect, the invention resides in a forming plow for use in an apparatus as aforesaid. The plow has at least two forming surfaces configured such that, when pressed against an interior side of a rectangular tube erected from a KDF precursor, the surfaces form an oblique wall panel of the container angled obliquely with respect to two adjoining container wall panels. Attachment means are located on a backside of the forming surfaces for removably attaching the plow to a movement actuator.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
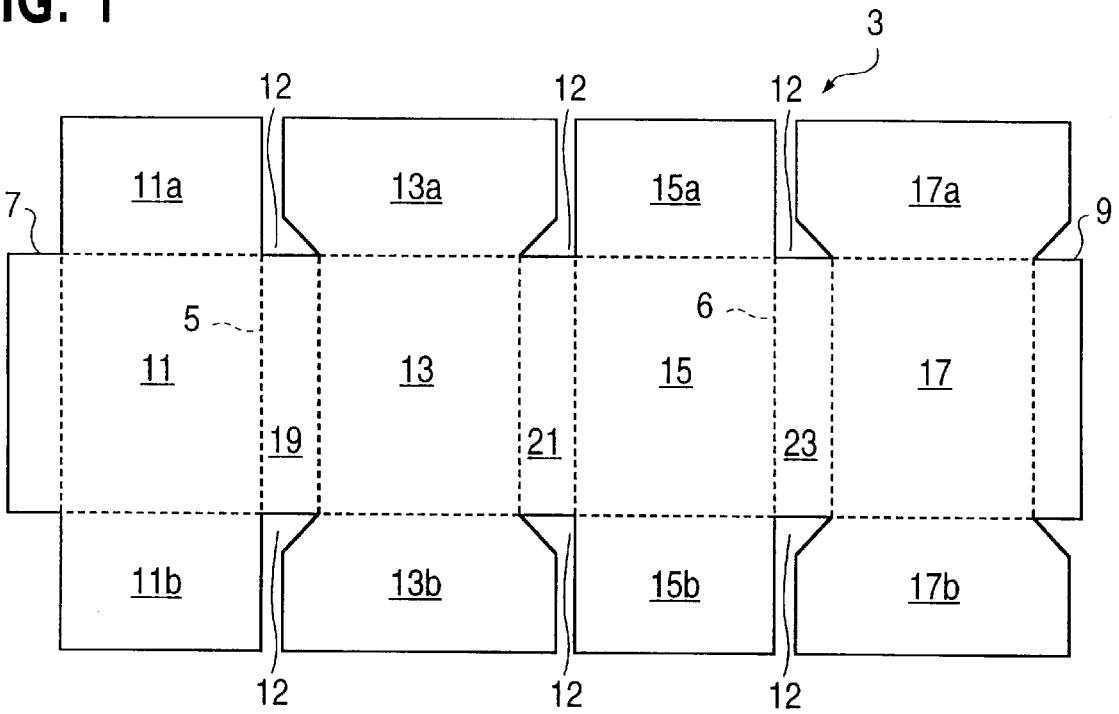
FIG. 1 is a plan view of a scored and slotted blank of sheet of material used to form a KDF precursor of an octagonal shipping container.
Figure 2:
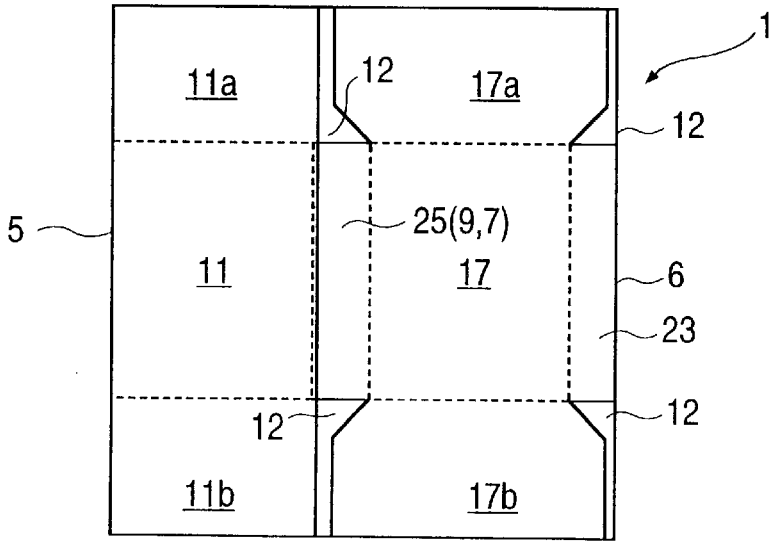
FIG. 2 is a plan view of a KDF container precursor formed from the blank shown in FIG. 1.

Referring first to FIGS. 1 and 2, it will be understood that a KDF precursor 1 (FIG. 2) of an octagonal shipping case is pre-formed from a blank 3 of scored and slotted sheet material such as corrugated paperboard or the like. To form precursor 1 from blank 3, the later is folded onto itself about score lines 5 and 6. End tabs 7, 9 are then overlapped and glued (or otherwise secured) together. Blank 3 comprises four primary wall panels 11, 13, 15 and 17, each having associated closure flap panels, 11*a, b*; 13*a, b*; 15*a, b*; and 17*a,b*. Between each pair of adjacent panels of primary wall panels 11, 13, 15 and 17 is a secondary (relatively narrow) wall panel 19, 21 and 23. End flaps 7, 9, once overlapped and secured together to form the endless KDF container precursor 1, form a fourth secondary wall panel 25. As will be described, the four secondary wall panels become oblique or diagonal corner wall panels in the finished octagonal case. Formation of these oblique wall panels is accommodated by the triangular cut-out areas 12 provided between the closure flap panels. Such cut-outs are shown formed in the major (larger) flaps 13*a, b*; 17*a, b*, but can instead be provided in the minor (smaller) flaps 11*a, b*; 15*a*, 15*b*.

Figure 3:
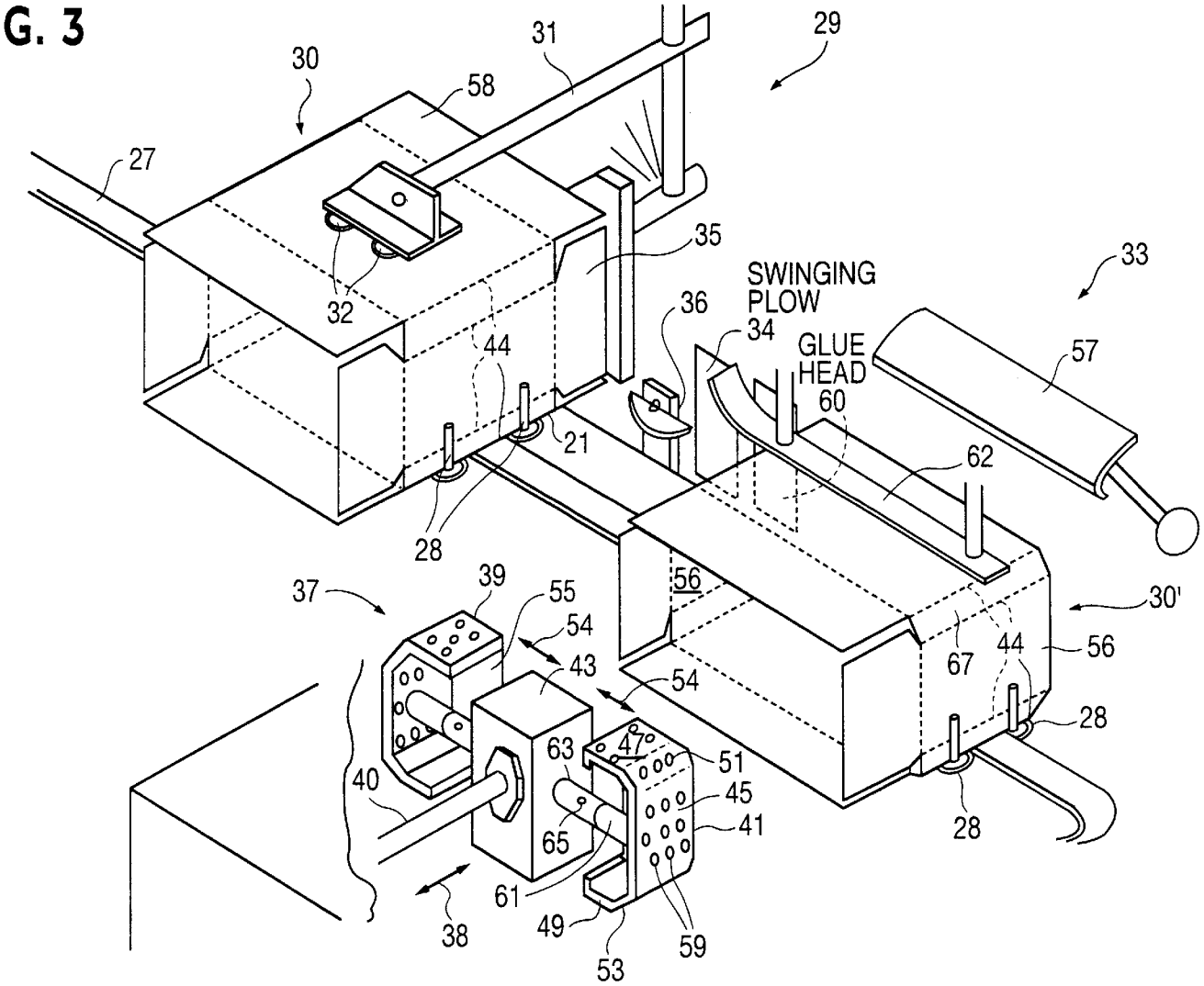
FIG. 3 is a simplified diagrammatic perspective view of a conveyor-type case packing mac modified in accordance with the present invention to allow formation of an octagonal shipping container, and showing sequential stages of the forming operation.

An exemplary process and apparatus in accordance with the present invention, for forming an octagonal shipping container from a KDF precursor similar to (but having different dimensions than) precursor 1 of FIG. 2, is now described with reference to FIG. 3. The apparatus of FIG. 3 comprises a conveyor 27 which moves intermittently a fixed distance corresponding to the equi-distance between each of four stations of a conveyor line. Conveyor 27 may be of known construction (e.g., single or dual belt design—the latter being preferred), and preferably includes conventional case stops 28 in the form of upstanding retractable pegs or the like, serving to fix the precursors relative to the conveying surface.

At an initial station (not shown), a known device takes the KDF precursors sequentially from a stack and places them on conveyor 27. Conveyor 27 delivers each KDF precursor to a second station 29 where the precursor is erected into a horizontally directed rectangular tube 30. This is accomplished with a conventional arrangement such as a pivotably mounted vacuum-cup gripping arm 31. While one set of vacuum cups (not visible) positioned below the conveyor maintains the bottom surface of the KDF precursor in contact with the conveyor belt(s), gripper arm 31 pivots down into contact with the top surface of the precursor. Arm 31 then pivots back to its top position bringing with it the top layer of the precursor, thereby causing unfolding of the precursor along its score lines and creating a rectangular tube 30 as shown. A pneumatic pump generates the vacuum for one or more suction cups 32 of arm 31 and can also be used to power the pivotal movement of arm 31. Standard arrangements of limit switches, valves and timing controls can be utilized to control the movement of the arm and the intermittent application of vacuum to suction cups 32 to effect the erection and release of the KDF precursors in synchronism with the intermittent motion of conveyor 27.

In the next cycle of movement, conveyor 27 advances rectangular tube 30 to a third station 33. En route to the third station, minor closure (bottom-forming) flaps of rectangular tube 30 are folded over by conventional tucking plows. The leading minor flap 35 can be folded-over 90° by a static plow 36, whereas the trailing flap (not visible) can be folded-over by a plow (schematically illustrated as bor 34) actuated to swing in the moving direction of the conveyor. Movement of conveyor 27 continues until rectangular tube 30 is positioned at third station 33. At the same time, conveyor 27 has moved another KDF precursor into second station 29. As the erecting process is carried out on a KDF precursor 30, final forming processes are carried out at third station 33 on the rectangular tube 30' that has advanced to that point. In the inventive apparatus, a ram head assembly 37 situated adjacent the conveyor 27 at third station 33 is initially in a retracted position allowing rectangular tube 30' to move into third station 33.

Ram head assembly 37 is mounted for rectilinear movement into and out of each rectangular tube 30' positioned at third station 33, as depicted by arrow 38, by way of a conventional adjustable stroke actuator such as a pneumatic piston/cylinder including a reciprocable mounting rod 40. In certain conventional case packers, a ram head comprising a plate may be provided to serve as a back-stop facilitating a folding over of a pair of closure flaps, and for pressing major and minor closure flaps into adhesive engagement. Ram head assembly 37 of the present invention is constructed differently, and includes forming plows 39, 41 extendable and retractable with respect to a central base member 43, into and out of pressing contact with opposing interior sides of rectangular tube 30'. In the illustrated embodiment, plows 39, 41 are configured as mirror-images of each other, are mounted on opposing sides of base 43, and are movable in opposing relation. Each plow includes forming surfaces corresponding in shape and size to the yet-to-be- formed oblique wall panels defined by score lines 44 provided in the rectangular tube. In particular, for forming an octagonal container as illustrated, each plow has a central vertical surface 45, upper and lower horizontal surfaces 47, 49 and upper and lower oblique or diagonal surfaces 51, 53 adjoining the opposite ends of vertical surface 45 with upper and lower horizontal surfaces 47, 49, respectively. In addition, each plow has a back-plate pressing surface 55 (only one clearly visible) arranged orthogonally with respect to forming surfaces 45, 47, 49, 51 and 53.

Ram head assembly 37 enters rectangular tube 30' with plows 39, 41 in a retracted position providing clearance between the plows and the tube sides. Head assembly 37 advances to a point which places plow back-plate surfaces 55 in a plane aligned with the score lines attaching the major (upper and lower) closure flaps to the corresponding wall panels. Next, plows 39, 41 are "punched" outwardly a stroke preset based on the desired container dimensions, in a direction orthogonal to the advancing direction of ram head assembly 37 (as indicated by arrows 54). As a result, the corner wall panels (e.g., 67) initially residing in the same plane as the primary end panels (e.g., 56) of the container assume their proper oblique angular orientation. The corresponding shape of the plows assures that these oblique corner wall panels are positively formed sharply and accurately along the score lines.

Plows 39, 41 remain in their extended position pressing against the inner sides of the container while a bottom sealing operation is carried out. In the sealing operation, the upper and lower (major) bottom flaps 58 are folded-over along their respective score lines, with accurate folding being facilitated by the aforesaid alignment of the plows with the score lines. Various known means can be utilized for performing the folding operation. In the illustrated embodiment, a pivotal arm 57 is actuated to swing downwardly in an arc to close the upper major flap, while another like arm (not shown) swings upwardly into contact with the first arm to close the lower major flap. Alternatively, known folders or rams moving linearly into contact with the outside of the flaps may be used. Before or during this folding operation, adhesive is applied to the outer sides of the minor flaps, or the inner sides of the major flaps, by a conventional glue head arrangement (schematically illustrated as box 60) dispensing fast acting hot glue or cold adhesive. The folding operation clamps the major and minor flaps tightly between pressing surfaces 55 of plows 39, 41 and the folding arms (or other external folding apparatus), thereby assuring a strong adhesive seal. An upper guide bar 62 may be provided for stabilizing rectangular tube 30' during the above-described sealing/oblique wall forming operations.

Once the bottom closure flaps are sealed, the octagonal container shape is fixed and stabilized, and plows 39, 41 retract inwardly toward base 43 to their original position. This provides a clearance allowing ram assembly 37 to (a) be retracted from the finished container and (b) enter a subsequent rectangular tube during the next cycle of operation. Once ram head assembly 37 is fully retracted from the finished container, a further cycle of intermittent conveyor movement advances the finished container 30' to a final station (not shown) where the container is presented for filling with product.

The reciprocation of the plows relative to base member 43 is preferably provided by an adjustable stroke pneumatic piston-cylinder arrangement contained within base 43. Plows 39, 41 are preferably constructed of aluminum or other lightweight structural material. It is desirable to provide vent holes 59 in the contact surfaces of the plows. This allows air to escape during the pressing operation, leading to formation of sharper container edges (corners).

Plows 39, 41 are preferably configured as quick-change parts that removably attach to the movable part of the pneumatic piston-cylinder arrangement within base 43. This can be accomplished using a male-to-female rod/tube assembly. For example, a circular, square or other angular shape rod 61 protruding from the backside of each plow 39, 41 can be made to slide inside of a piston rod 63 protruding from the base member 43. These parts can be secured together by a bolt, pin 65 (spring loaded or otherwise) or the like. This, along with the adjustability of the pneumatic actuators, allows easy adaptation of the apparatus to the forming of containers of different sizes and configurations (including standard rectangular containers), by use of appropriately sized and configured plows providing the necessary pressing surfaces.

It will be appreciated that while the preferred embodiment includes two plows mounted for movement in opposition to each other, and in a horizontal plane, the principles of the invention can be carried out with various other arrangements, including (but not limited to) a single plow movable outwardly from a base positioned against an opposite sidewall of the rectangular tube, or one or a pair of plows mounted to move outwardly from base 43 in a vertical rather than a horizontal direction, in order to form one or more oblique panels in the upper and lower sides of the rectangular tube. Moreover, the invention is not limited to a single pair of plows. For example, two pairs of opposed plows could be provided in orthogonal relationship with each other, for simultaneously forming oblique wall panels in both the horizontal and vertical sides of the rectangular tube.

While each plow 39, 41 is preferably configured to be symmetrical about its central point of attachment, corresponding to the symmetrical configuration of the octagonal container to be formed, it will be understood that the invention is not limited to a symmetrical plow shape serving to simultaneously form a pair of opposed oblique wall panels. Rather, one or more plows could have an asymmetrical configuration, e.g., essentially comprising a top or bottom half of plows 39, 41, or another asymmetrical design, for forming one or more oblique wall panels.

It will further be understood that the formation of an oblique wall panel from one of the sides of rectangular tube 30, as shown, may be carried out with arrangements other than the three adjacent forming surfaces (e.g., 47, 51, 45) as shown. It will be appreciated, e.g., that formation of an oblique corner panel 67 could be carried out with various combinations of two of the three adjacent forming surfaces (e.g., 47, 51, 45), due to the bracing action and folding that would occur even without a full forming surface for each of the adjacent wall panel surfaces.

Additionally, it should be understood that a case packer in accordance with the invention could be configured to work with KDF precursors opened (e.g., at second station 29) to present vertically oriented rectangular tubes on conveyor 27. In this case, it will be understood that ram head assembly 37 could be configured above conveyor 27, to extend into and retract from the presented rectangular tube in a vertical rather than a horizontal direction.

The present invention has been described in terms of preferred and exemplary embodiments thereof Numerous other embodiments, modifications and variations within the scope and spirit of the appended claims will occur to persons of ordinary skill in the art from a review of this disclosure.

What is claimed is:

1. A method of setting-up a non-rectangular container with an oblique wall panel from a knock-down-fiat (KDF) precursor formed of scored, slotted and folded panels of sheet material, said method comprising:

opening said KDF precursor to form a rectangular tube;

advancing a ram head assembly into said rectangular tube, said head assembly including a base and a plow movable toward and away from said base;

actuating said plow to move away from said base and into engagement with an interior side of said rectangular tube, to thereby form an oblique wall panel of said container angled obliquely with respect to two adjoining container wall panels;

folding over end flaps of said container into contact with each other;

securing said end flaps to each other while said plow is engaged with said interior side;

actuating said plow to retract from said interior side following said securing; and retracting the ram head assembly out of the resultant container;

wherein said method is performed as an automated conveyor line operation.

2. A method according to claim 1, wherein said actuation of the plow simultaneously forms a pair of said oblique wall panels.

3. A method according to claim 1, wherein a pair of said plows are simultaneously actuated to form an oblique wall panel in each of a pair of opposing sides of said rectangular tube.

4. A method according to claim 3, wherein said actuation of each plow simultaneously forms a pair of oblique corner wall panels in each of said pair of opposing sides of said rectangular tube, to form an octagonal container.

5. A method according to claim 3, wherein the movement of the plows relative to the base is orthogonal to the advancing direction of the ram head assembly.

6. A method according to claim 5, wherein the movement of the plows is generally horizontal.

7. A method according to claim 1, wherein said rectangular tube is oriented generally horizontally on said conveyor line and said advancement of the ram head assembly into the rectangular tube is generally horizontal.

8. A meth according to claim 1, wherein said securing comprises adhesively bonding said end flaps using said plow as a pressing surface.

9. A method according to claim 1, wherein the dimensions of said oblique wall panel are predefined by score lines in said KDF precursor, said formation of the oblique wall panel occurring by way of folding along said score lines induced by said engagement of the plow with said interior side of the rectangular tube.

10. An apparatus for forming a non-rectangular container with an oblique wall panel from a knock-down-flat (KDF) precursor formed of scored, slotted and folded panels of sheet material, said apparatus comprising:

a support device for supporting a rectangular tube erected from a KDF precursor, said support device comprising an automated linear conveyor;

a ram head assembly movably mounted adjacent said support device, said assembly including a base and a plow;

a first actuator for controllably moving said ram head assembly into and out of a said rectangular tube positioned on said support device;

a second actuator for controllably moving said plow away from said base and into engagement with an interior side of said rectangular tube, to thereby form an oblique wall panel of said container angled obliquely with respect to two adjoining container wall panels;

folding means for folding over end flaps of said rectangular tube into contact with each other; and securing means for securing said end flaps to each other while said plow is engaged with said interior side;

said second actuator causing said plow to retract from engagement with said interior side following operation of said securing means, said first actuator retracting said ram head assembly out of the resultant container after said retraction of the plow.

11. An apparatus according to claim 10, further comprising erecting means arranged along said automated conveyor upstream of said ram head assembly, for erecting a said rectangular tube from a KDF precursor positioned on said conveyor.

12. An apparatus according to claim 10, wherein said plow is symmetrically configured to simultaneously form a pair of said oblique wall panels.

13. An apparatus according to claim 10, wherein said ram head assembly comprises a pair of said plows mounted on said base in opposing relationship to each other, and said second actuator moves said plow in synchronism to simultaneously form an oblique wall panel in each of a pair of opposing sides of said rectangular tube.

14. An apparatus according to claim 13, wherein each said plow is configured to form a pair of oblique comer wall panels in each of said pair of opposing sides of said rectangular tube, to thereby form an octagonal container.

15. An apparatus according to claim 13, wherein the movement of the plows relative to the base is orthogonal to the moving direction of the ram head assembly.

16. An apparatus according to claim 15, wherein said movement of the plows is generally horizontal.

17. An apparatus according to claim 10, wherein the movement of the ram head assembly into and out of the rectangular tube is generally horizontal.

18. An apparatus according to claim 10, wherein said securing means comprises an adhesive bonding device and said ram head assembly includes a pressing surface for pressing said end flaps together to facilitate an adhesive bond of the same.

19. A ram head assembly for use in an apparatus for forming a non-rectangular container with an oblique wall panel from a knock-down-flat (KDF) precursor formed of scored, slotted and folded panels of sheet material, said assembly comprising:

a base adapted for attachment to movement actuating means;

a plow movably mounted on said base, said plow having forming surfaces which, when pressed against an interior side of a rectangular tube erected from said KDF precursor, form an oblique wall panel of said container angled obliquely with respect to two adjoining container wall panels, said plow comprising two forming surfaces arranged orthogonally with respect to each other, and a third forming she interconnecting said two forming surfaces and being angled obliquely with respect thereto; and an actuator for controllably moving said plow away from said base and into engagement with said interior side of the rectangular tube.

20. An assembly according to claim 19, wherein said plow member is symmetrically configured to simultaneously form a pair of said oblique wall panels.

21. An assembly according to claim 19, wherein said assembly comprises a pair of said plow members mounted on said base in opposing relationship to each other, and said actuator moves said plows in synchronism to simultaneously form an oblique wall panel in each of a pair of opposing sides of said rectangular tube.

22. An assembly according to claim 21, wherein each said plow is configured to form a pair of oblique corner wall panels in each of said pair of opposing sides of said rectangular tube, to thereby form an octagonal container.

23. An apparatus according to claim 19, wherein said plow is detachably connected to said base to allow a rapid inter-change of plows for forming containers of different size and configuration.

24. A forming plow for use in an apparatus for forming a non-rectangular container with an oblique wall panel from a knock-down-flat (KDF) precursor formed of scored, slotted and folded panels of sheet material, said plow comprising:

two forming surfaces arranged orthogonally with respect to each other, and a third forming surface interconnecting said two forming surfaces and being angled obliquely with respect thereto, said forming surfaces b configured such that, when pressed against an interior side of a rectangular tube erected from said KDF precursor, the surfaces form an oblique wall panel of said container angled obliquely with respect to two adjoining container wall panels; and attachment means located on a backside of said forming surfaces for removably attaching said plow to a movement actuator.

25. A forming plow according to claim 24, further comprising a pressing surface arranged orthogonally with respect to each of said three forming surfaces.

26. A forming plow according to claim 24, wherein said forming surfaces are planar and connected to each other along linear edges.

27. A forming plow according to claim 24, wherein said plow member is symmetrically configured to simultaneously form a pair of said oblique wall panels.

28. A forming plow for use in an apparatus for forming a non-rectangular container with an oblique wall panel from a knock-down-flat (KDF) precursor formed of scored, slotted and folded panels of sheet material, said plow comprising:

at least two forming surfaces configured such that, when pressed against an interior side of a rectangular tube erected from said KDF precursor, the surfaces form an oblique wall panel of said container angled obliquely with respect to two adjoining container wall panels, at least one of said forming surfaces having ventilation passages formed therein; and attachment means located on a backside of said forming surfaces for removably attaching said plow to a movement actuator.

* * * * *

UNITED STATES PATENT AND TRADEMARK OFFICE

CERTIFICATE OF CORRECTION

PATENT NO. : 6,106,450
DATED : August 22, 2000
INVENTOR(S) : Jody A. Brittain

It is certified that error appears in the above-identified patent and that said Letters Patent is hereby corrected as shown below:

On the cover page, right column, line 15, --Company product description: "The Inland Container 'Octi-Pack'", Inland Container Corp., date: certain pages bear 1995 dates-- has been inserted.

Column 1, line 30, "fist" has been deleted and in its place --first-- has been inserted;

line 32, "filing" has been deleted and in its place --filling-- has been inserted.

Column 3, line 19, "contain" has been deleted and in its place --container-- has been inserted;

line 46, "mac" has been deleted and in its place --machine-- has been inserted.

Column 4, line 49, "bor" has been deleted and in its place --box-- has been inserted.

Column 7, line 7, immediately after "thereof", --.-- has been inserted;

line 55, "meth" has been deleted and in its place --method-- has been inserted.

Column 8, line 40, "comer" has been deleted and in its place --corner-- has been inserted.

Column 9, line 33, "b" has been deleted and in its place --being-- has been inserted.

Signed and Sealed this

First Day of May, 2001

*Attest:*

Nicholas P. Godici

NICHOLAS P. GODICI

*Attesting Officer*

*Acting Director of the United States Patent and Trademark Office*